US006120140A

United States Patent [19]

Hirosawa et al.

[11] Patent Number: 6,120,140

[45] Date of Patent: Sep. 19, 2000

[54] INK SUPPLYING APPARATUS AND INK RECORDING APPARATUS HAVING SAME

[75] Inventors: Toshiaki Hirosawa, Hiratsuka; Hajime Kishida, Tokyo; Osamu Morita, Yokosuka; Mineo Kaneko, Tokyo; Kiyomitsu Kudo, Yokohama, all of Japan

[73] Assignee: Canon Kabushiki Kaisha, Tokyo, Japan

[21] Appl. No.: 09/014,406

[22] Filed: Jan. 28, 1998

Related U.S. Application Data

[63] Continuation of application No. 08/444,688, May 19, 1995, abandoned.

[30] Foreign Application Priority Data

May 20, 1994 [JP] Japan ..... 6-106676
Nov. 30, 1994 [JP] Japan ..... 6-296661

[51] Int. Cl.[7] ..... B41J 2/19

[52] U.S. Cl. ..... 347/93

[58] Field of Search ..... 347/85, 86, 87, 347/92, 93, 94

[56] References Cited

U.S. PATENT DOCUMENTS

| | | | |
|---|---|---|---|
| 4,183,029 | 1/1980 | Isayama et al. | 347/93 |
| 4,514,743 | 4/1985 | Röschlein et al. | 347/68 |
| 4,775,871 | 10/1988 | Abe et al. | 347/86 |
| 5,231,424 | 7/1993 | Kaneko et al. | 347/29 |
| 5,296,875 | 3/1994 | Suda | 347/93 |
| 5,457,485 | 10/1995 | Moriyama et al. | 356/241.3 |
| 5,546,109 | 8/1996 | Nakano | 347/93 |
| 5,561,448 | 10/1996 | Kaneko et al. | 347/29 |

FOREIGN PATENT DOCUMENTS

| | | |
|---|---|---|
| 0585901 | 9/1994 | European Pat. Off. . |
| 3621193 | 6/1986 | Germany . |
| 56-151570 | 11/1981 | Japan . |

*Primary Examiner*—N. Le
*Assistant Examiner*—Anh T. N. Vo
*Attorney, Agent, or Firm*—Fitzpatrick, Cella, Harper & Scinto

[57] ABSTRACT

An ink supplying apparatus includes an ink flow passage connecting an ink storing portion for storing ink and an ejecting portion for ejecting the ink; a chamber disposed in the ink flow passage; a filter which divides the chamber into two spaces, one of which is provided with an ink entrance opening leading to the ink storing portion, and the other of which is provided with an ink exit opening leading to the ejecting portion; wherein the ink exit opening is disposed adjacent to the top wall of the chamber, with respect to gravity direction, and also, the ink exit opening is disposed above a level at which the ink entrance opening is disposed, with respect to direction.

9 Claims, 9 Drawing Sheets

INK SUPPLYING APPARATUS AND INK RECORDING APPARATUS HAVING SAME

This is a continuation of the U.S. application Ser. No. 08/444,688 filed May 19, 1995, now abandoned.

FIELD OF THE INVENTION AND RELATED ART

The present invention relates to an ink jet recording apparatus, in particular, an ink jet recording apparatus comprising an foreign matters removing apparatus for removing foreign matters.

Generally speaking, in an apparatus exemplified by an ink jet recording apparatus or the like, in which recording liquid is flowed through a liquid passage with a microscopic section, it is necessary to prevent the liquid from being insufficiently supplied due to the liquid passage blockage caused by foreign matters in the liquid (ink), that is, the foreign matters such as liquid (ink) deposit, bubbles, and the like which enter the liquid passage during the installation or removal of an ink container as an ink storing portion.

In particular, the ink jet recording apparatus is liable to suffer from this blockage caused by the foreign matters or ink deposit. This is because it has ejection orifices for ejecting ink droplets, and these orifices are extremely small relative to the internal diameter of the liquid passage, being thereby liable to be blocked.

Therefore, normally, in order to prevent the blockage of the ejection orifice portion, an foreign matters removing apparatus has been disposed in an ink supplying system for supplying the ink from the ink container, which is the ink storing portion, to the ejection orifices. This foreign matters removing apparatus is constituted of a chamber or the like provided with a filter which removes the microscopic foreign matters or bubbles.

A schematic view of the basic structure of such an ink jet recording apparatus is given in FIG. 1, and a schematic section of the general structure of the filter chamber as a conventional foreign matters removing apparatus, which has been employed in this ink jet recording apparatus depicted in FIG. 2. The ink jet recording apparatus depicted in FIG. 1 is of a type that carries out a performance restoring operation by recirculating the ink.

Referring to FIG. 1, a reference numeral 8 designates an ink container as an ink storing portion; 9, a gear pump for pressure-feeding the ink; 10, a power source for driving the gear pump; 11, a switch for controlling the driving of the pump; and a reference numeral 12 designates a recording head for ejecting the ink. It should be noted here that for the sake of simplication, the ink container 8 is schematically drawn with its top open, but the ink container 8 generally comprises an opening, through which the internal space thereof is in communication with the atmosphere.

A reference numeral 20 designates a filter chamber as the foreign matters removing apparatus; 21, an inflow tube as an ink supply tube, through which the ink is flowed into the foreign matters removing apparatus; and a reference numeral 22 designates an outflow tube as an ink flow passage, through which the ink is led out of the filtering apparatus. This foreign matters removing apparatus 20 is disposed in both the ink passage leading from the ink container 8 to the recording head 12, and the ink flow passage returning to the ink container 8 from the recording head.

Referring to FIG. 2, the foreign matters removing apparatus 20 comprises a filter 1, wherein a reference numeral 2 designates an ink entrance opening and a reference numeral 3 designates an ink exit opening.

In the above structure, as the ink 13 within the ink container 8 is initially supplied to the recording head 12, or when the gear pump 9 is activated to circulate the ink through the ink supplying system, the ink 13 from the ink container 8 enters the gear pump 9 by way of the ink supply tube 23, flows through the inflow tube 21, enters the foreign matters removing apparatus 20 disposed on the pump side through the ink entrance opening 2, passes through the filter 1, and reaches the recording head 12 by way of the ink exit opening 3.

In a structure such as the above structure, in which bubbles are removed by recirculating the ink, the ink is pressure-fed by the pump from the ink container to the recording head through the ink supply passage 23 constituting the outward passage, and the inflow tube 21,; and then, is further pressure-fed by the pump, being thereby returned from the recording head to the ink container through the outflow tube 22 constituting the return passage. Through such an ink recirculation, the bubbles existing in the outward ink passage, return ink passage, and recording head are returned to the ink container, where they are separated from the ink and released into the atmosphere.

Therefore, the filter of the foreign matters removing apparatus disposed in the aforementioned outward ink passage or return ink passage must allow the bubbles to pass when the gear pump 9 is activated.

On the other hand, when the ink is supplied from the ink container to the recording head through the outward ink passage during a recording operation, the ink is generally not pressure-fed by the pump, and instead, is supplied using the capillary force or the like of the ink in the recording head or the like. In this case, normally, the ink is supplied by the capillary force mainly from the ink exit tube 22 side, where flow resistance is smaller.

Also in this case, the bubble must not be allowed to pass through the filter of the foreign matters removing apparatus. This is because when the bubbles having entered the recording head exist in the ink passage on the ejection orifice side, ejection becomes instable, and in the worst case, the ejection may become impossible.

Having described the problems involving the foreign matters in the ink, the foreign matters removing apparatus illustrated in FIG. 2 could not satisfy the prerequisites for the filter operated in the various modes such as the ones described above.

Referring to FIG. 2(*b*), the ink 13 flowed in from the direction of an arrow mark a is sent to the foreign matters removing apparatus 20 comprising the filter 1 through an unillustrated inflow tube. The ink 13, which flows through the ink exit opening 3, is filtered by the filter 1 that does not pass the foreign matters or the like larger than 10 $\mu$m in diameter. Because of the presence of this filter 1, the foreign matters 7 within the ink 13 accumulate on the arrow mark a side, which is the upstream side of the filter 1. In this case, the foreign matters do not flow into the side of an arrow mark b, which constitutes the outflow tube.

In such a conventional filter chamber 20 as the one described above, the aforementioned bubbles are liable to enter the ink flow passage (ink supply system passage), being thereby mixed into the ink, or remain on the upstream side of the filter chamber 20. Further, it is liable that even after the bubbles having accumulated on the upstream side of the filter chamber 20 pass the filtering portion, they rise due to their buoyancy and tend to linger at the point of ink flow stagnation, which develops at the top portion of the filter 1, on the downstream side, adhering subsequently to the filter within the filter chamber and reducing thereby the effective area of the filter. As a result, it is liable that the ink pressure is reduced to a point where unsatisfactory ink ejection occurs during the recording operation.

In recent years, it has become the main stream of the apparatus design to reduce the apparatus size. This has been accomplished by disposing the ink storing portion as well as the recording means on a carriage that scans the recording medium, instead of providing a long liquid supply route connecting the ink storing portion to the aforementioned recording means.

More specifically, the recording means and ink storing portion are in the form of cartridge, and can be individually mounted in, or removed from, the recording apparatus, even though they remain integrated while they are in the recording apparatus.

This arrangement has such an advantage that when the ink stops coming out of the recording means, the recording operation can be restarted just by replacing the ink storing portion. In other words, it reduces the running cost.

Further, this arrangement has a smaller component count compared to a structure in which the recording means and ink storing portion are not separable; therefore, it is easier to deal with the used components like the ink depleted ink storing portion, reducing thereby the impact on the environment.

Presently, in addition to the demands for the aforementioned size reduction, there are increased demands for higher picture quality, which is accomplished by increasing the imaging resolution, and also, for higher recording speed. A frequently employed means for obtaining this high resolution is to make finer the ink ejecting nozzles generally provided within the recording means.

When the nozzles are made finer to increase the resolution, it is necessary to reduce the mesh size of the foreign matters screening filter disposed in the ink supply passage leading from the ink storing portion to the recording means. On the other hand, in order to increase the recording speed, it is necessary to increase the amount of the ink to be supplied per unit of time from the ink storing portion to the recording means. Thus, in order to increase both the resolution and recording speed, the pressure difference between the upstream and downstream sides of the film tends to increase. Therefore, the amount of pressure loss increases, which is liable to lead to response frequency loss.

As for effective means for suppressing this problem, the dimension of the filter in the filtering portion may be increased so that the effective area through which the ink passes can be increased. As for the structure of the filtering portion, a filter chamber is generally disposed at a predetermined point of the ink supply passage which connects the ink ejecting portion of the recording means and the ink storing portion. However, when the cartridge type design is employed for the recording means and ink storing means in order to reduce the apparatus size, there is a limit to the size to which the filter area is increased.

Further, when the total surface area of the walls constituting the flow passage increases due to the expansion of the filter chamber, it is more probable that gas enters the ink flow passage through the members constituting the walls, and forms bubbles therein, during an extended period of usage, even if a cartridge type ink storing portion (hereinafter, ink cartridge) and/or cartridge type recording means such as a recording head (hereinafter, recording head cartridge) are employed. This phenomenon is similar to the one that is frequently experienced when the recording means and ink storing portion are connected with a tube or the like as described before.

When these bubbles remain adhered to the filter and reduce the effective area of the filter, the response frequency drops, which leads to the unstable ejection. In other words, just increasing the dimension of the filter within the filtering portion is not sufficient to maintain the steady ejection.

Normally, the removal of the bubbles adhering to the filter occurs when the ink is sucked through the ejection orifices of the recording means to restore the recording performance of the apparatus, and in order to remove completely the bubbles, a sucking apparatus with a large capacity is necessary, which goes against the trend of reducing the apparatus size.

In particular, when the structure illustrated in FIG. 3 is employed, in which in order to reduce the apparatus dimension in the width direction, the ink flow passage is arranged in parallel to the gravity direction as it is in case the ink storing portion and ink ejecting means are disposed on the top and bottom sides, respectively, relative to the filtering portion, the aforementioned problematic phenomenon is more apparent. This is because the bubbles in the ink flow passage below the filter 1 are more liable to adhere to the filter 1 due to their buoyancy, and as a result, the bubble sin the filtering portion are more liable to grow and reduce the effective area.

On the other hand, the buoyancy (arrow mark C in the drawing) of the bubble 4 on the ink storing portion side of the filter 1 works against the force (arrows mark D) which is generated in the direction of passing the bubble through the filter during the performance restoring operation; therefore the probability that the bubble 4 remains there increases.

SUMMARY OF THE INVENTION

The primary object of the present invention is to solve the aforementioned various problems, and thereby, to provide an ink jet recording apparatus capable of removing effectively the bubbles so that the ink is consistently and stably ejected, wherein the ink entrance opening of the foreign matters removing apparatus is disposed at a substantially central portion thereof, and the ink exit opening is disposed at the topmost portion thereof to smooth the ink flow, eliminating thereby the development of the spot where the bubbles tend to linger, so that the bubbles can be effectively removed.

Another object of the present invention is to provide an ink jet apparatus and an ink supplying apparatus which do not invite the increase in size and complexity thereof caused by the increase in the size or the like of the recording head cartridge provided with the ink flow passage.

Another object of the present invention is to prevent the deterioration of the recording image quality resulting from the instable ejection caused by the bubble adhesion to the filtering portion.

A further object of the present invention is to provide an ink jet apparatus and an ink supplying apparatus which are capable of surely removing the bubbles even when an attempt is made to reduce the apparatus size in the width direction thereof by disposing the ink storing portion and ink ejecting means on the top and bottom sides of the filter, respectively, relative to the gravity direction.

According to an aspect of the present invention, there is provided an ink supplying apparatus comprising: an ink flow passage connecting an ink storing portion for storing ink and an ejecting portion for ejecting the ink; a chamber disposed in the ink flow passage; a filter which divides the chamber into two spaces, one of which is provided with an ink entrance opening leading to the ink storing portion, and the other of which is provided with an ink exit opening leading to the ejecting portion; wherein the ink exit opening is disposed adjacent to the top wall of the chamber, with respect to gravity direction, and also, the ink exit opening is disposed above a level at which the ink entrance opening is disposed, with respect to direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
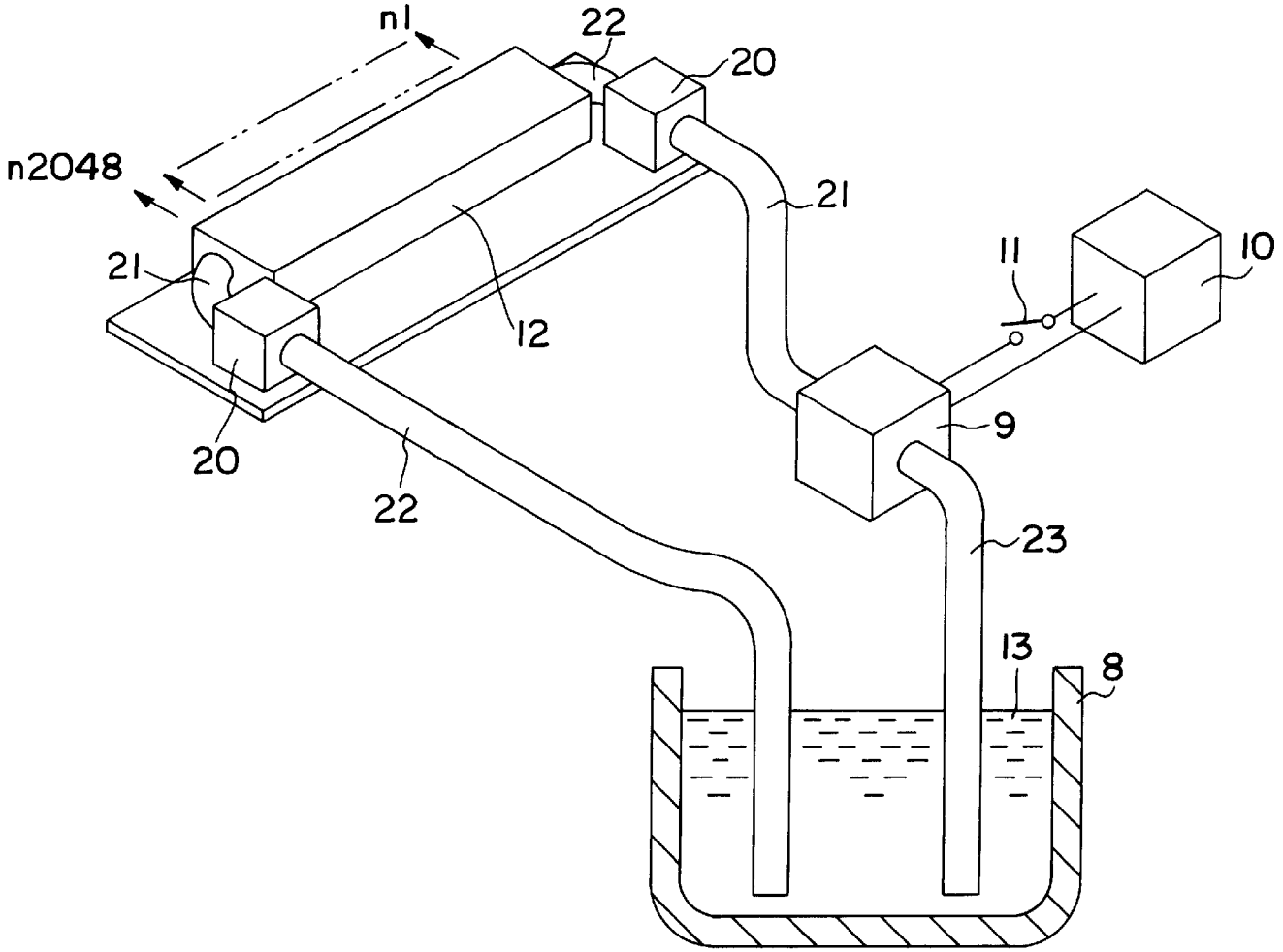
FIG. 1 PRIOR ART
FIG. 1 is a schematic perspective view of an example of conventional foreign matters removing apparatus.
Figure 2A:
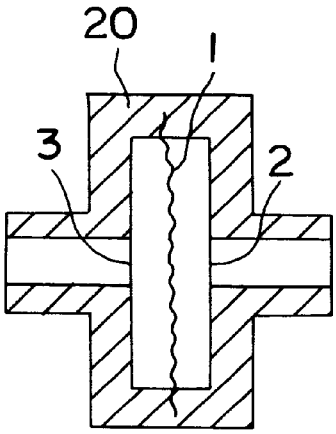
FIG. 2(a) PRIOR ART
FIGS. 2(*a*) and 2(*b*) an schematic sectional views of an example of the filtering portion of the conventional foreign matters removing apparatus.
Figure 2B:
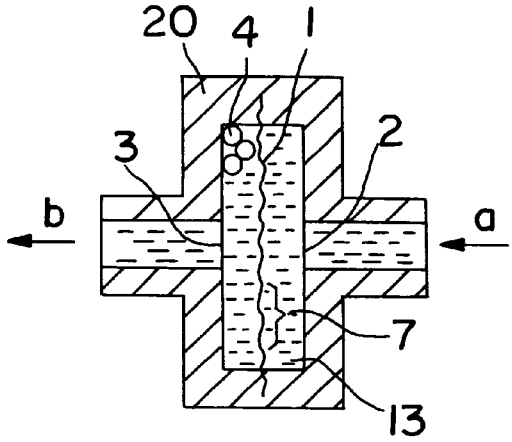
FIG. 2(b) PRIOR ART
Figure 3:
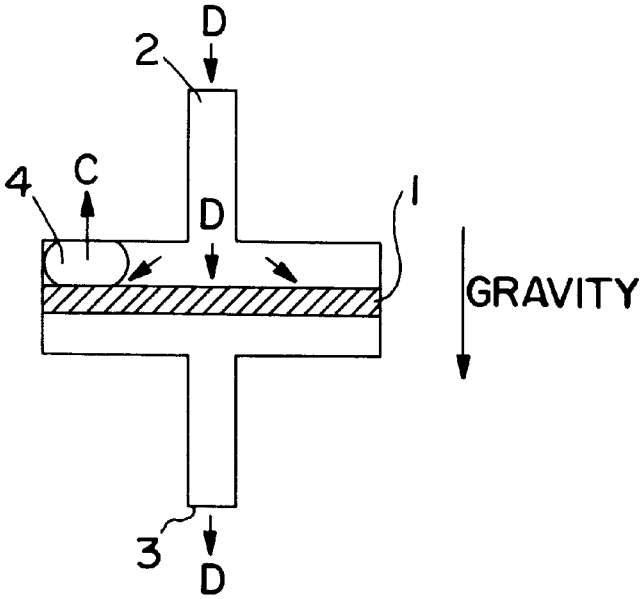
FIG. 3 PRIOR ART
FIG. 3 is a schematic sectional view depicting the shape of the filtering portion of the ink supplying system in the conventional small ink jet apparatus.

Hereinafter, the embodiments of the present invention will be described in detail referring to the drawings.

Embodiment 1

Figure 4A:
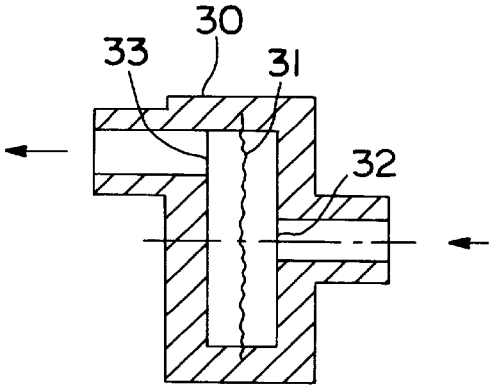
FIGS. 4(*a*) and 4(*b*) is a schematic sectional views of the first embodiment of the foreign matters removing apparatus according to the present invention.
Figure 4B:
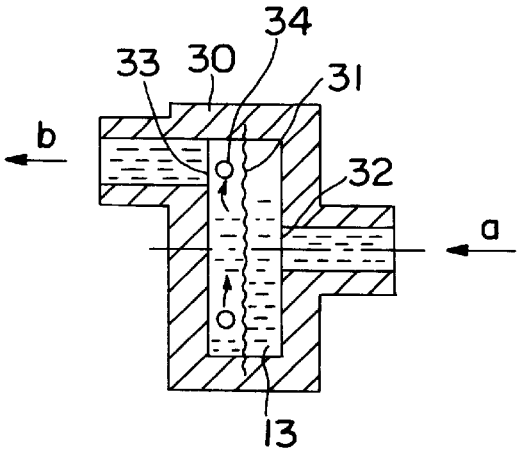

FIG. 4 is a schematic sectional view of the first embodiment of the present invention, depicting a filter chamber 30 as the foreign matters removing apparatus. The foreign matters removing apparatus of this embodiment is disposed at the same location as the foreign matters removing apparatus 20 is disposed in the ink jet recording apparatus illustrated in FIG. 1.

In FIG. 4, a reference numeral 31 designates a filter which dose not allow the foreign matters such as small foreign matter or the deposit from the ink to pass. It is consisted of mesh filter of SUS or the like, and is firmly fixed within the foreign matters removing apparatus, using thermal welding or the like.

A reference numeral 32 designates an ink entrance opening. When this foreign matters removing apparatus is disposed on the pump 9 side in the structure illustrated in FIG. 1, this ink entrance opening is connected to the pump 9 with an inflow tube 21 or the like. When the apparatus is disposed on the ink container 8 side, it is connected to the ink liquid chamber of the recording head 12 with the inflow tube 21 or the like.

A reference numeral 33 designates an ink exit opening, which is disposed at the top portion of the foreign matters removing apparatus 30. In the case of the structure illustrated in FIG. 1, when the foreign matters removing apparatus is disposed on the pump 9 side, this ink exit opening 33 is connected to the ink liquid chamber of the recording head 12 with the outflow tube 22 or the like. When the apparatus 30 is disposed on the ink container 8 side, this ink exit opening 33 is connected to the ink container 8 with the outflow tube 22 or the like.

As for the positional relationship between the ink entrance opening 32 and ink exit opening 33, the ink exit opening 33 is disposed at the top portion of the filter mounting portion, relative to the gravity direction, and the ink entrance opening 32 is disposed below the ink exit opening 33 in the gravity direction, as shown in FIG. 4.

In the above structure, when the gear pump 9 is activated to supply the ink 13 within the ink container 8 to the recording head 12, or to circulate the ink 13, the ink 13 within the ink container 8 is sent to the recording head 12 through the inflow tube 21, ink entrance opening 32 of the foreign matters removing apparatus 30 disposed on the pump side, filter 31, and ink exit opening 33.

Referring to FIG. 4, during this ink movement, the bubbles in the ink and/or the bubble 34 within the foreign matters removing apparatus 30 collect at the top portion due to the buoyancy thereof, and then, all of them are moved to the recording head 12 side through the ink exit opening 33 disposed at the topmost portion of the filter 31, by the ink flow which is generated as the means for pressure-feeding the ink, such as the gear pump 9, is driven.

Also in the foreign matters removing apparatus 30 disposed on the ink container 8 side, the bubble 34 enters through the ink entrance opening 32, passes through the filter 31, and is delivered to the ink container 8 through the ink exit opening 33, just as it is on the pump 9 side.

Thus, the phenomenon that the effective area of the filter is reduced by the bubbles, which linger within the ink flow passage even after the completion of the performance restoring operation, can be prevented by changing the positional relationship between the two openings of the filter chamber from that of the conventional structure. This is because such a change causes the ink flow to change its direction within the filter chamber, which, in conjunction with the ink viscosity, suppresses the development of the point of ink stagnation where the bubbles linger.

Figure 5:
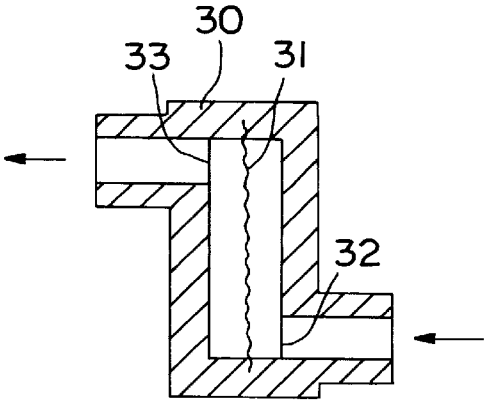
FIG. 5 is a schematic sectional view of a modification of the first embodiment of the foreign matters removing apparatus according to the present invention.

FIG. 5 shows a modification of the preceding embodiment. In this case, the ink entrance opening 32 of the filter chamber is differently disposed from the preceding embodiment. In FIG. 5, the same components as those illustrated in FIG. 4 are given the same designations to omit their description. In FIG. 5, the ink entrance opening 32 is disposed below the center of the filter 31. This arrangement creates a stronger upward ink flow within the foreign matters removing apparatus 30 during the performance restoring operation. In other words, the ink flow component moving in the gravity direction in the filter chamber 30 increases; therefore, it becomes more difficult for the bubbles to linger in the top portion of the filter chamber 30, which in turn makes it possible to remove surely the bubbles.

Figure 6:
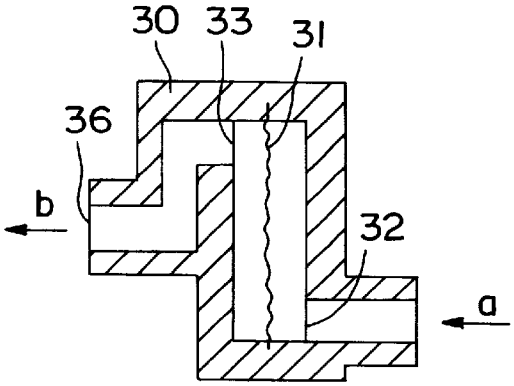
FIG. 6 is a schematic sectional view of another modification of the first embodiment of the foreign matters removing apparatus according to the present invention.

It should be noted here that a tube connecting opening 36, that is, the external opening through which the ink flows out of the filter chamber, may be disposed so that it indirectly corresponds to the ink entrance opening 33 as shown in FIG. 6.

Embodiment 2

Figure 7A:
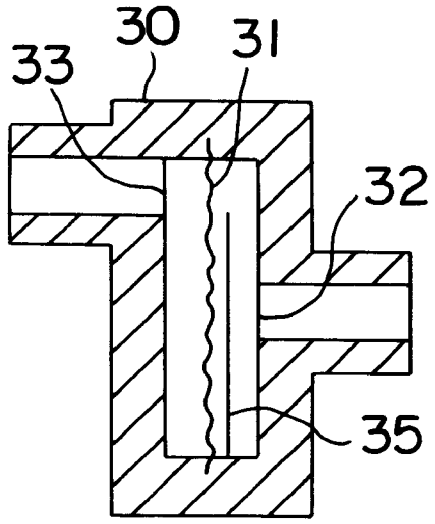
FIGS. 7(*a*) and 7(*b*) are schematic sectional views of the second embodiment of the foreign matters removing apparatus according to the present invention.
Figure 7B:
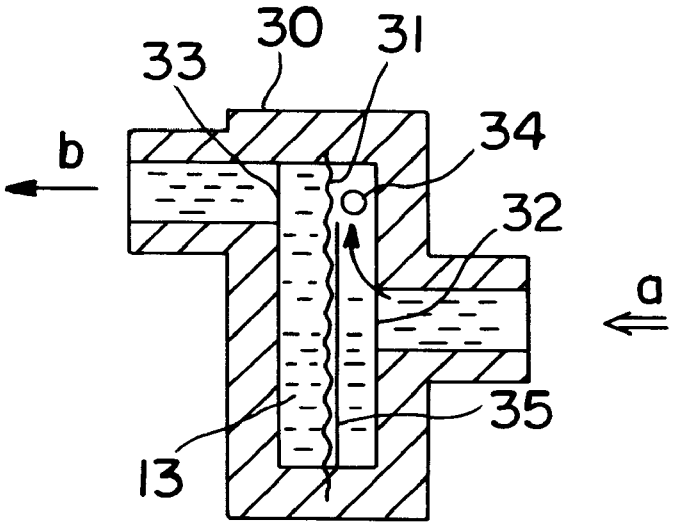

FIG. 7 is a schematic sectional view of the second embodiment of filter chamber as the foreign matters removing apparatus according to the present invention. In FIG. 7, the same components as those illustrated in FIG. 4 are give the same designations to omit the descriptions. In FIG. 7, a valve 35 is such a valve that comes in contact with the filter 31 as shown in FIGS. 7(*b*) when the amount of the ink flow per unit of time at the filtering portion increases while the ink is circulated by the pump 9.

Compared to the structure with no provision of the valve 35 in the foreign matters removing apparatus 30, the provision thereof can increase the pressure difference between the front and back sides of the filter 31 while the ink is circulated for the recovery operation; therefore, the ink flow with a higher pressure can be generated at the filter 31 by the gear pump or the like, whereby the bubbles are more efficiently passed through the filter 31.

In this case, it is more preferable for the ink entrance opening 32 to be disposed at substantially the middle portion of the foreign matters removing apparatus than at the bottom portion thereof. This is because such disposition of the ink entrance opening 32 allows the valve to move smoothly in response to the amount of the ink flow within the ink supply passage, and also, allows the valve to cling surely to the filter 31 by the entire surface thereof, so that the bubble 34 adhering to the filter surface can be easily removed.

Also, the disposition of the ink exit opening 33 at the top portion of the foreign matters removing apparatus 31 makes it possible to send the bubble 34 completely out of the filter chamber without inviting it to linger therein.

As is evident from the above description, when the ink entrance opening of the foreign matters removing apparatus is disposed at a substantially middle portion of the foreign matters removing apparatus, or below the middle thereof, and also, when the ink exit opening is disposed at the top portion of the filter of the foreign matters removing apparatus, it is possible to remove satisfactorily the foreign matters within the ink. In particular, the bubbles within the ink at the bubbles accumulated within the foreign matters removing apparatus can be completely removed. As a result, it is possible to provide an ink jet head capable of ejecting the ink constantly and stably.

Next, a description is given as to a case in which the present invention is applied to the filter chamber of a structure in which the ink storing portion is mounted on a carriage for mounting recording means which records images as it scans the surface of the aforementioned recording medium.

Figure 8:
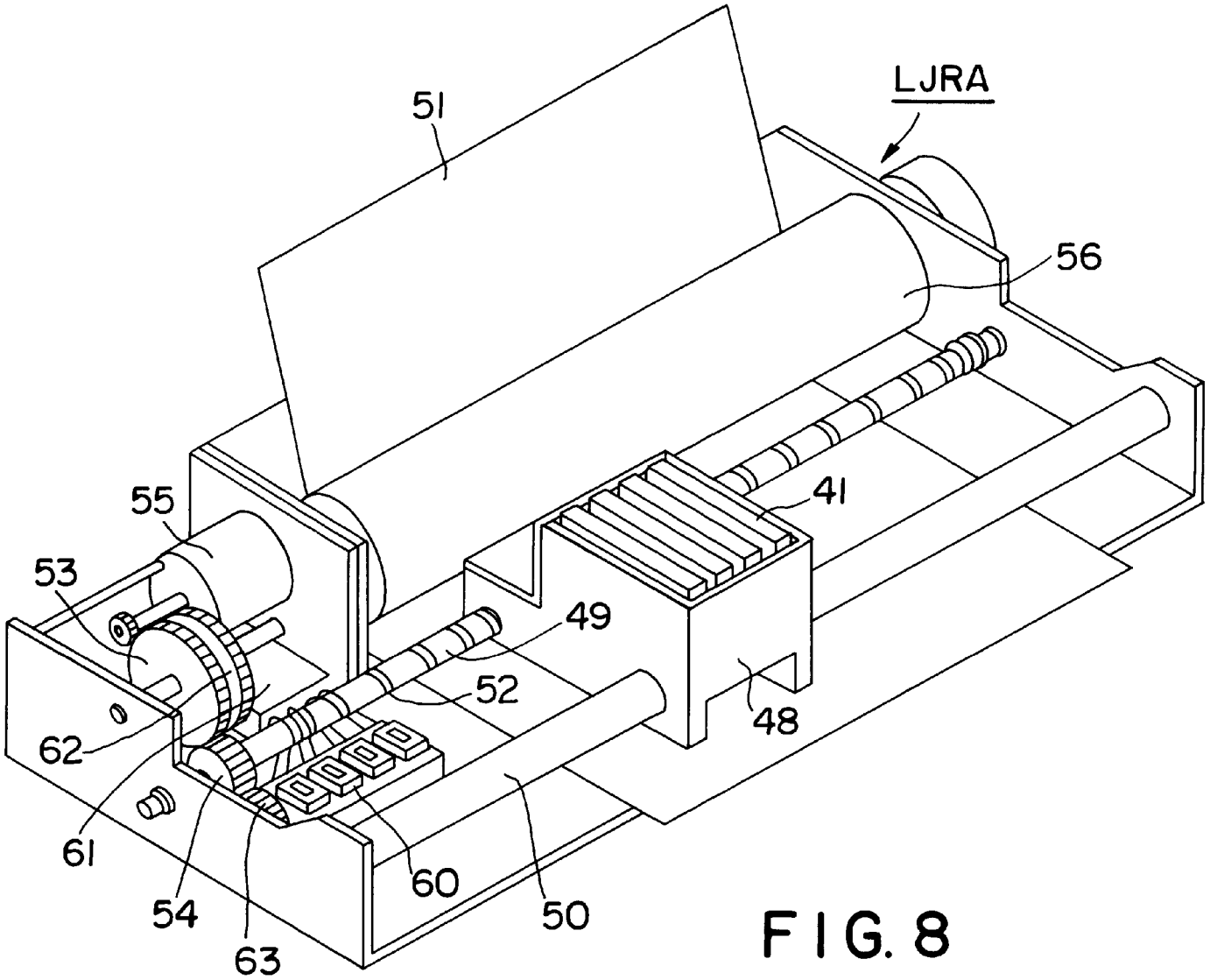
FIG. 8 is a schematic perspective view of an embodiment of ink jet apparatus according to the present invention.

To begin with, a schematic perspective view of an exemplary ink jet apparatus IJRA comprising the recording means and ink storing portion, which are mounted on the carriage, is given in FIG. 8. In FIG. 8, a reference numeral 41 designates an ink cartridge as the ink storing portion, and a reference numeral 48 designates a carriage on which the ink cartridge 41 and a recording head cartridge 42 as the recording means, which will be described later, are removably mounted.

A reference numeral 49 designates a lead screw for making the carriage 48 scan a recording medium 51 such as a sheet of recording paper or plastic material, and a reference numeral 50 designates a guide rail for guiding the scanning movement of the carriage 48. The movement of the lead screw 49 is linked to the forward and backward rotation of a driving motor 55 by way of gears 53 and 54, wherein a spiral groove 52 cut in the lead screw 49 is in engagement with an unillustrated engagement portion provided on the carriage 48, and therefore, the carriage 48 is driven to scan in the longitudinal direction of the apparatus by the driving motor 55. The recording medium 51 is conveyed by a platen roller 56.

Further, performance restoring means for restoring the performance of the ejecting portion provided in the recording means, which will be described later, is disposed adjacent to the path of the recording medium 51. This performance restoring means comprises a cap member 60 for capping the ejection orifice portion (unillustrated) of the recording head cartridge, and a sucking means 61 for restoring the performance of the ejecting portion by sucking it through an internal opening (unillustrated) provided within the cap member 60. To this sucking means, the driving force from the driving motor 55 is transmitted by well-known transmitting means comprising a gear 62, a switching clutch, and the like.

As for the vertical and related movements of the cap member 60, it is caused by the driving force transmitted by way of a gear 63 or the like, wherein, in order to suck the ejection orifices to restore their performance, and in order to slow the ink evaporation, the cap member 60 is placed airtightly in contact with the surface where the ejection orifices are present.

Further, the aforementioned performance restoring sucking operation can not only restore the performance of the clogged ejection orifices, but also discharge the ink contained in the ink flow passage portion between the ink cartridge and ejecting portion by changing the amount of the ink to be sucked, so that the microscopic foreign matters, bubbles, or the like can be removed from the filtering portion as well as the ink flow passage. This ink flow passage performance restoring operation is carried out with regular intervals, or is compulsively carried out whenever determined to be necessary by a user, so that preferable print quality can be maintained.

The aforementioned capping and performance restoring sucking operation are carried out at the correspondent locations while the carriage 48 is in the appropriate region on the home position side. Also, these operations are performed, independently or in combination, using well-known timing and sequence, or optionally.

Embodiment 3

Figure 9:
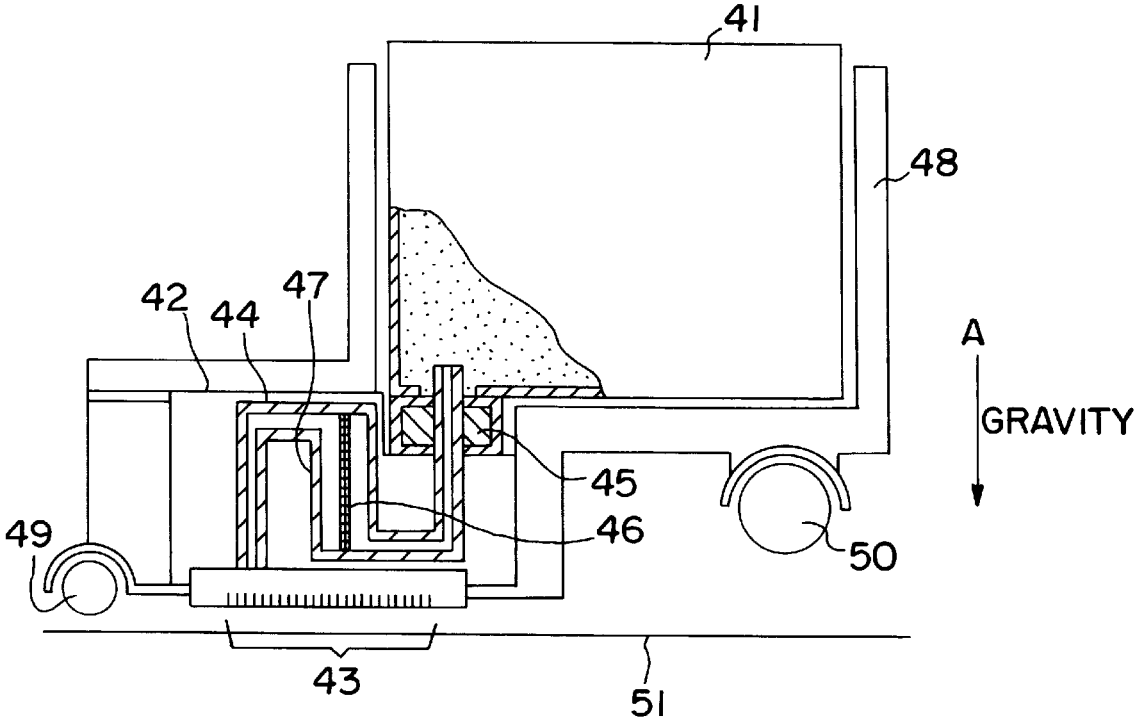
FIG. 9 is a schematic sectional view of the third embodiment of the present invention, depicting the adjacencies of the carriage portion of the ink jet apparatus.
Figure 10:
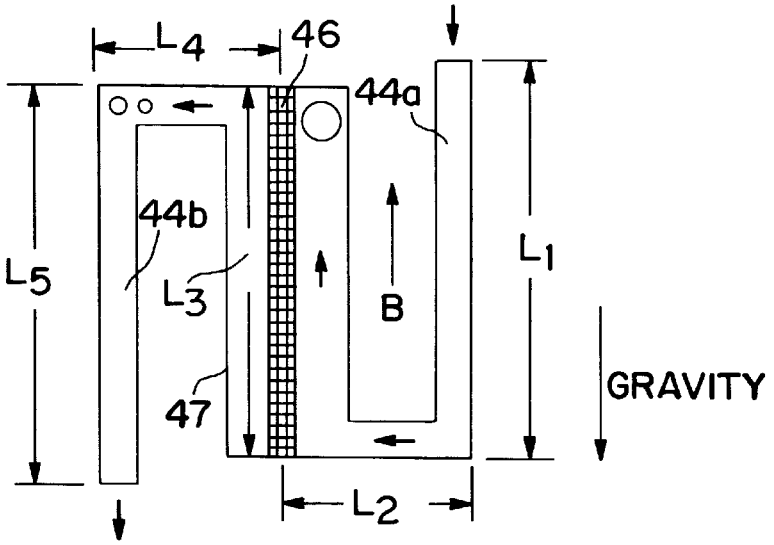
FIG. 10 is an enlarged sectional view of the ink flow passage illustrated in FIG. 9.

Given in FIG. 9 is a schematic sectional view of the third embodiment of the present invention, depicting a recording head cartridge and an ink cartridge, which are on the carriage of an ink jet recording apparatus. Given in FIG. 10 is an enlarged sectional view of an ink flow passage 44 constituting the ink supplying system (ink supplying apparatus) illustrated in FIG. 9. The arrow mark A in the drawing indicates the gravity direction.

Referring to FIG. 9, a reference numeral 41 designates an ink cartridge, which is an ink storing portion for storing the ink, and a reference numeral 42 designates a recording head cartridge as the recording means for recording images using the ink supplied from the ink cartridge 41.

A reference numeral 43 designates the ejecting portion comprising nozzles (ejection orifices) for ejecting the ink, and a reference numeral 44 designates an ink flow passage connecting the ink cartridge 41 and ejecting portion 43. A reference numeral 45 designates a joint portion which watertightly connects the interior of the ink cartridge to the ink flow passage 44 when the ink cartridge 41 is mounted, and which seals the ink cartridge 41 when the ink cartridge 41 is removed. In this embodiment, this joint portion 45 is formed of elastic material, like rubber, wherein the tip of the ink flow passage 44 is connected to this joint portion 45 of elastic material using a well-known conventional method.

The ink flow passage 44 comprises a double-back passage portion 47 containing a filter 46, and the other ink flow passage portions connecting this double-back flow passage portion 47 to the ink storing portion and ejecting portion, respectively. In this embodiment, this double-back flow passage constitutes the filter chamber.

It should be noted here, though it is not going to be detailed, that in this embodiment, the pressure at the nozzle portion of the ink cartridge 41 is set below the atmospheric pressure with the provision of a well-known pressure regulating mechanism such as a multi-chamber structure comprising a connecting portion for forming a meniscus.

The aforementioned ink cartridge 41 and recording head cartridge 42 are structured so that they can be removably mounted on the carriage 48. This carriage 48 is supported by a guide shaft 49, which is a rail provided in the ink jet apparatus, and is moved on the guide shaft for scanning during the recording operation. In this embodiment, the recording medium 50 is placed perpendicular to the gravity direction, whereas the ink ejected from the nozzle 43 files in parallel to the gravity direction.

Next, the flows of the ink and bubbles in this embodiment will be described. As the ink is sucked through the ejection orifice by the aforementioned performance restoring apparatus or the like, the ink within the ejecting portion 43 is sucked out, and a new supply of ink from the ink cartridge 41 is filled into the ejecting portion 43.

The ink flow at this time will be described referring to FIG. 10. In FIG. 10, an ink flow passage 44*a* is a connecting passage leading to the ink cartridge 41 storing the ink, and the bottom end of an ink flow passage 44*b* is a connecting passage leading to the recording head cartridge 42 comprising the ejecting portion. As for the sectional configuration of the ink flow passage, it is bent; more specifically, it doubles back at the top and bottom portions of the filter chamber 47. Therefore, the ink flow passage 44 is structured to have a bent portion at a point where the ink flow passage 44*a* connects to the double-back flow passage 17, and at a point where the double-back flow passage 47 connects to the ink flow passage 44*b;* in other words, the double-back flow passage is disposed between the two bent portions.

The ink flows down from the ink cartridge 41 side through the ink flow passage 44*a* in the gravity direction; flows into the adjacencies of the bottom portion of the double-back flow passage 47 in which the filter 46 is disposed; and thereafter, flows through the double-back flow passage 47 in the direction opposite to the gravity direction, that is, in the direction of the buoyancy indicated by an arrow mark B in the drawing. Then, the ink enters the ink flow passage 44*b* from the adjacencies of the topmost portion of the double-back flow passage 47; flows downward again in the gravity direction; and reaches the ejecting portion 43 side where the nozzles are. This ink flow described above results from the pressure difference between the pressure generated at the ejecting portion by the sucking means 61 and the cap 60 adhering airtightly to the ejecting portion, and the pressure working on the ink cartridge.

On the other hand, a bubble larger than a certain size moves along with the aforementioned ink flow, and in this embodiment, the ink flow passages 44*a* and 44*b* are made relatively small, and given a uniform cross section across their length, so that this bubble movement can be enhanced. Therefore, the speed of the ink flow increases within the ink flow passages 44*a* and 44*b,* detaching easily the bubbles adhering to the flow passage walls, and thereby, making it easier for them to be discharged from the ejecting portion during the performance restoring operation.

As for the filter chamber 47 constituted of the double-back flow passage, it extends in the gravity direction, being connected to the ink flow passages 44*a* and 44*b* at the bottom and top portions, respectively. In this embodiment, the opening portions are disposed at the bottommost and topmost portions, respectively. This arrangement is made to give the ink flow passage 44 a smooth flow passage structure in which the ink flow stagnation is unlikely to occur; therefore, the loss of the sucking force generated by the performance restoring system can be reduced, increasing subsequently the force working on the bubbles.

Further, the filter chamber is structured so as to allow the ink to flow in the direction of the buoyancy working on the bubbles; therefore, not only the bubbles clinging to the filter 46 are more easily detached, but also, the bubbles within the ink flow passage 44*a* can also be more easily passed through the filter 46, during the performance restoring operation. Consequently, the bubble removal from the filtering portion by the performance restoring sucking operation can be rendered more reliable.

Further, in this embodiment, the filter is disposed in parallel to the direction of the ink flow within the filter chamber 47 constituted of the double-back flow passage; therefore, the effective area of the filter can be increased without increasing the cross section of the double-back flow passage, relative to the direction of the ink flow. With this arrangement, it is possible, without increasing the apparatus size, to decrease the pressure loss which occurs when the ink passes through the filter 46 during the recording operation or the like. Therefore, even when the amount of the ink supply per unit of time is increased in order to increase the recording speed, or the mesh size of the filter is reduced in order to obtain higher resolution, the ink supplying performance does not deteriorate.

Embodiment 4

Figure 11:
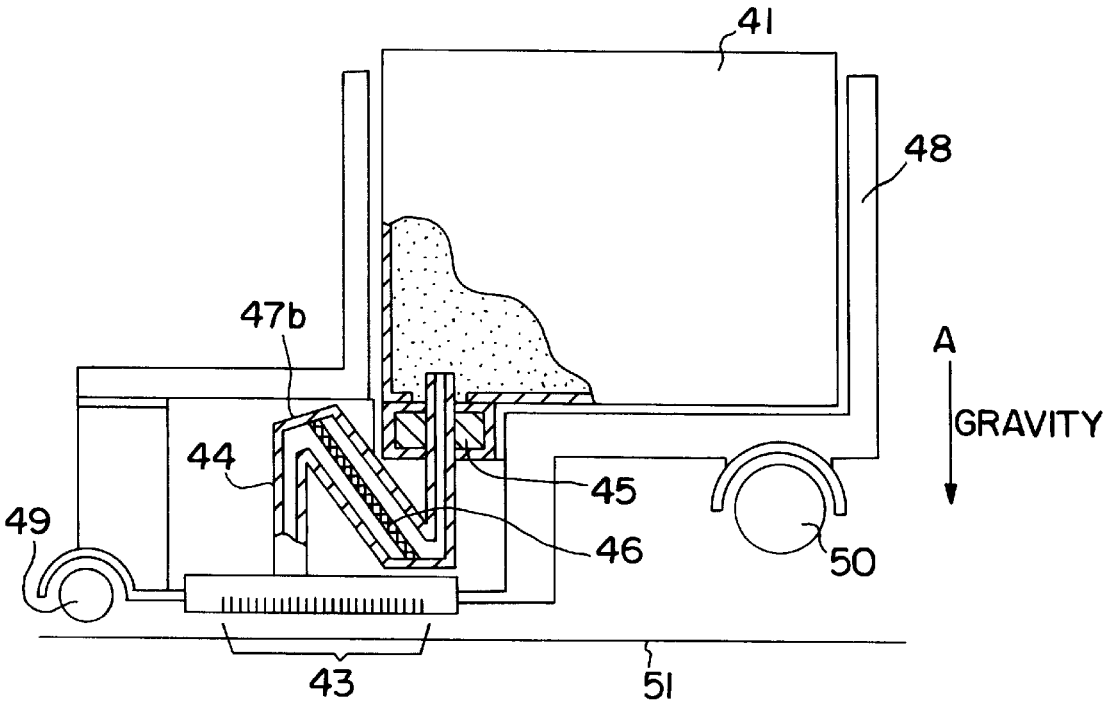
FIG. 11 is a schematic sectional view of the fourth embodiment of the present invention, depicting the adjacencies of the carriage portion of the ink jet apparatus.
Figure 12:
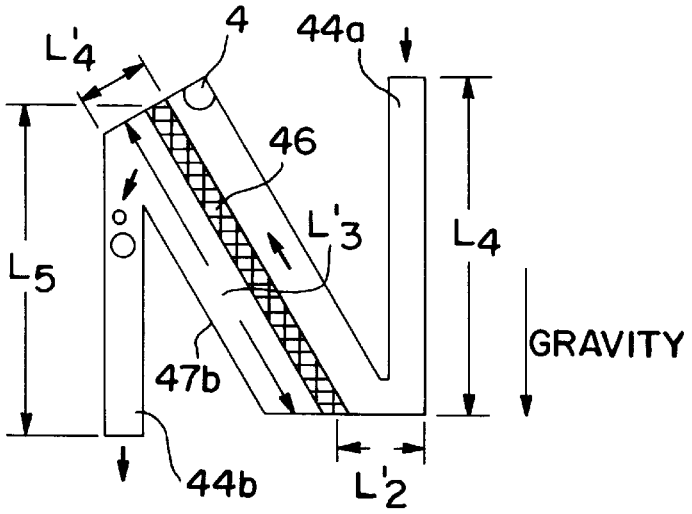
FIG. 12 is an enlarged sectional view of the ink flow passage illustrated in FIG. 11.

The fourth embodiment of the present invention is given in FIGS. 11 and 12. FIG. 11 is a schematic sectional view of a recording head cartridge and an ink cartridge, which are on the carriage of an ink jet recording apparatus. FIG. 12 is an enlarged sectional view of the ink flow passage 44 illustrated in FIG. 11.

Referring to FIG. 11, the structure of this embodiment is different from the aforementioned embodiment in that the filter chamber 47*b* is tilted relative to the gravity direction (or the horizontal direction perpendicular of the gravity direction).

The other structures are the same as those in the third embodiment. As shown in FIG. 12, the ink flow passage 44*a* and 44*b* are relatively narrow, having a uniform cross section across their length; therefore, the speed of the ink flow is increased within the ink flow passages 44*a* and 44*b*. They are connected to the bottommost and topmost portions, respectively, of the filter chamber 47*b* constituted of the double-back flow passage.

When the filter chamber 47 is slanted relative to the gravity direction, or the horizontal direction perpendicular to the gravity direction, not only can the total number of the bent portions in the longitudinal sectional view be decreased, but also, the overall length of the ink flow passage itself can be shortened. As is evident from FIGS. 10 and 12, when the longitudinal sectional areas of the ink flow passages 44 in the first and this embodiment are compared, L2+L3+L4>L2'+L3'+L4.' In other words, the total flow passage length of this embodiment is shorter than that of the first embodiment. Consequently, using the structure of this embodiment further reduces the total flow passage resistance, whereby not only does it become easier to increase the recording speed and resolution, but also, it becomes possible to reduce the loss of the force which works on the bubbles in the filtering portion during the performance restoring operation. Therefore, the more complete bubble removal by the performance restoring sucking operation can be assured.

Further, the reduction of the total wall surface area decreases the probability of the gas permeation into the ink flow passage, which is frequently observed during a prolonged usage.

It is also discovered that when the foreign matters removing apparatus is structured like this embodiment in which the filter 46 is disposed so as to extend in the direction of the slanted flow passage 47*b*, it is possible to make it more difficult for the microscopic bubbles to cling to the filter 46, and also, it becomes easier to remove them from the flow passage. As for the microscopic bubbles mentioned above, it is more liable for them to develop when surfactant is mixed into the ink as means for obtaining picture quality of a higher degree. Since the cross sections of these microscopic bubbles are extremely small, the ink pressure does not satisfactorily affect them; in other words, it is rather difficult to force them through the filtering portion. It particular, when the bubbles with an approximately the same size as the mesh size of the filter adhere to the filter, they tend to remain there in stable condition due to the surface tension or the like; therefore, it is difficult to remove them, reducing consequently the effective area of the filter.

However, when the structure according to this patent application is employed, the double-back ink flow passage 47*b* and filter 46 are disposed with a certain angle relative to the gravity direction or the horizontal direction perpendicular to the gravity direction; therefore, the buoyancy of the bubbles effects in the direction of detaching them from the filter.

Consequently, even when the ink is flowing, it is more difficult for the bubbles to adhere to the filter, and also, it is easier for them to separate therefrom. At the same time, it is easier for them to move along the flow passage wall to the top space of the filter chamber constituted of the double-back ink flow passage, where they, the microscopic bubbles, join together, and thereby, grow into larger bubbles. Thus, it becomes possible to remove even the microscopic bubbles in the same manner as the ordinary bubbles, and thereby, to prevent the effective filter area from being reduced by the bubbles. As a result, high quality images can be obtained.

Other Embodiments

Figure 13A:
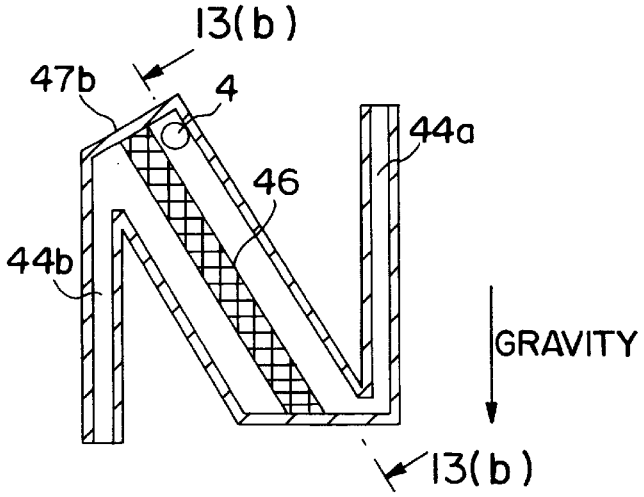
FIGS. 13(*a*) and 13(*b*) are schematic sectional views of a modification of the fourth embodiment.
Figure 13B:
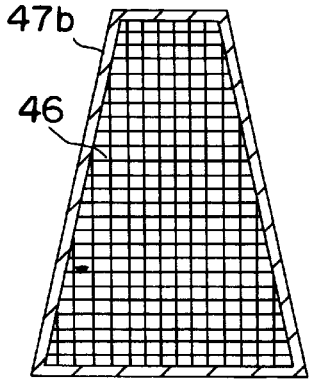

A modification of the fourth embodiment is shown in FIG. 13. FIG. 13(*a*) is a schematic sectional view of the ink flow passage 44, and FIG. 13(*b*) is a schematic sectional view of the ink flow passage 44, at a sectional line P—P indicated in FIG. 13(*a*). In this embodiment, a trapezoidal configuration illustrated in FIG. 13(*b*) is employed for the double-back flow passage so that the cross section of the filter chamber constituting a portion of the ink flow passage 44 gradually decreases toward the top.

With the employment of this structure, the speed of the ink flow drops once as the ink enters from the ink flow passage 44*a* into the filter chamber, and thereafter, gradually increases toward the top of the filter chamber 47*b*, becoming fastest at the topmost portion of the filter chamber 47*b*, where the bubbles are most likely to collect.

This effect, in conjunction with the aforementioned effects of the preceding embodiment, further reduces the force necessary to pass the bubbles through the filter 46; therefore, the force necessary to be applied to the filtering portion, that is, the force required of the sucking means, decreases. Thus, this embodiment allows the apparatus size to be further reduced, and also allows the mesh size to be further reduced, so that the nozzle size can be further reduced to improve the image resolution. It should be noted here that even though the trapezoidal configuration is employed in this embodiment, the configuration is not limited to this one, and may be optionally selected as long as it reduces the cross section of the double-back flow passage portion toward the top.

Figure 14A:
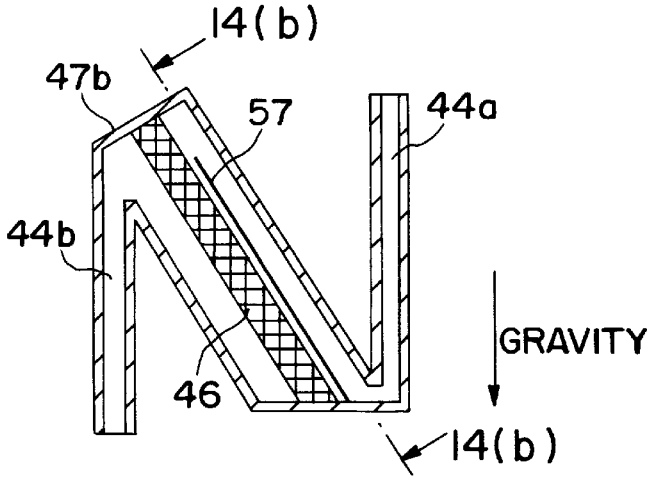
FIGS. 14(*a*) and 14(*b*) are schematic sectional views of another modification of the fourth embodiment.
Figure 14B:
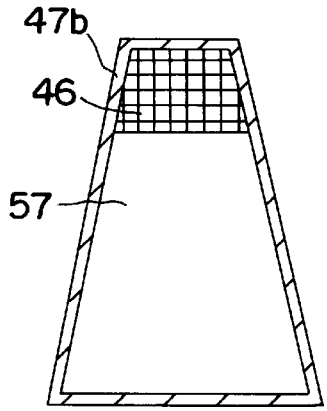

FIG. 14 illustrates another modification for increasing the ink flow speed adjacent to the top portion of the double-back ink flow passage 47*b*, where the double-back ink flow passage 47*b* is connected to the top end opening of the ink flow passage 44*b*. In this modification, a valve mechanism is added to the structure described in the foregoing in order to increase further the ink flow speed during the performance restoring operation. FIG. 14(*e*) is a schematic sectional view of the ink flow passage 44, and FIG. 14(*b*) is a schematic sectional view of the ink flow passage 44, at a sectional line Q—Q indicated in FIG. 14(*a*).

Referring to FIG. 14(*a*), this structure comprises a valve 57 which remains separated from the filter 46 during an actual recording operation, that is, while the performance restoring operation is not carried out. The valve 57 is placed in the filter chamber, on the ink flow passage 44*a* side of the filter 46, that is, on the ink storing portion side. It is a 10–100 μm thick sheet of resin material such as PPS.

As for the configuration and material for the valve 57, they are not limited to those described in the foregoing as long as they can provide such elasticity that does not allow the valve 57 to come in contact with the filtering portion when the ink is slowly flowing, as it is during the actual recording operation, and allows it adhere to the filter so that the effective area of the filter is reduced when the pressure difference between the upstream and downstream sides of the filter is large, as it is during the performance restoring operation.

With the employment of this structure, it is possible to generate the pressure difference and pressure strong enough to pass reliably the bubbles through the filter 46 during the performance restoring operation, without deteriorating the print quality during the recording operation.

In the case of the structure illustrated in FIG. 14, it is highly probable that the bubbles, which invade into the gap between the filter 46 and valve 57 and adhere to the filter 46, becomes difficult to remove during a routine performance restoring operation; therefore they are liable to reduce the effective area of the filter during the recording operation; therefore they are liable to reduce the effective area of the filter during the recording operation, or to prevent the valve from functioning effectively during the performance restoring operation. Thus, it is preferable that the valve is structured as described below.

Figure 15A:
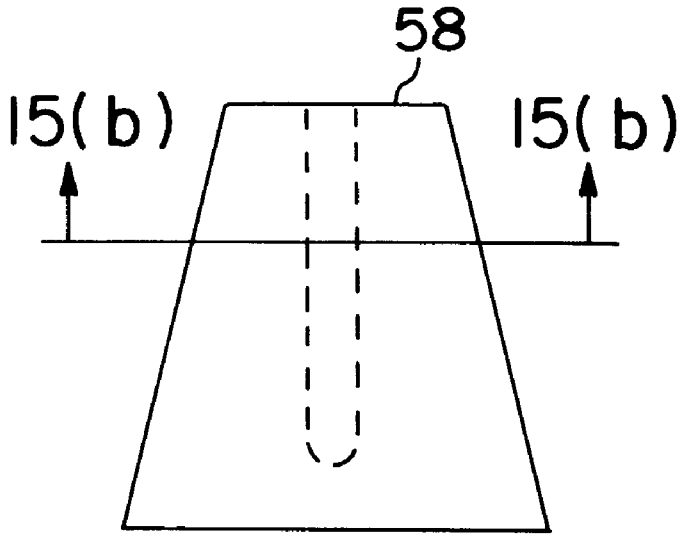
FIGS. 15(*a*) and 15(*b*) are sectional views of a modification of the embodiment illustrated in FIG. 14.
Figure 15B:
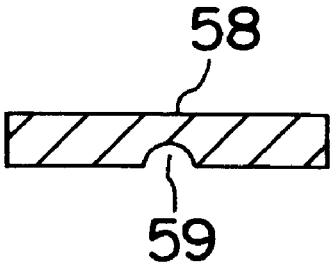

FIG. 15 shows such a valve structure. FIG. 15(*a*) is a schematic view of such a valve as seen from the direction of Q indicated in FIG. 14, and FIG. 15(*b*) is a schematic sectional view of the same valve, at a sectional line R—R indicated in FIG. 15(*a*). In this structure, a grooved portion 59 is provided on the valve 58. This structure is particularly effective when the bubbles are lodging between the filter and valve due to the surface tension or the like. The presence of the grooved portion 59 enhances the upward movement of the bubbles in the filter chamber, in conjunction with the buoyancy of the bubbles themselves, and the surface tension which works to sphere the bubbles; therefore, the bubbles can be discharged from between the filter and valve.

As described hereinbefore, the present invention can be employed in a device having only a small space available for the placement of the filter chamber, such as the aforementioned carriage on which the recording means and ink storing portion are mounted, wherein since the structure employed is such that the ink is allowed to flow in the direction in which the buoyancy of the bubbles works, not only the detachment of the bubbles adhering to the filter becomes easier, but also, it becomes easier for the bubbles within the ink flow passage to pass through the filter. Therefore, the bubble removal by the performance restoring operation can be rendered more reliable.

Further, a double-back flow passage portion constituting a portion of an ink flow passage portion is disposed between two bends of the ink flow passage in a manner to intersect with the gravity direction, and a filter is disposed in a manner to extend in the same direction as this ink flow passage portion between these two bends extends, that is, in a manner to extend in the direction of the ink flow; therefore, the effective area of the filter can be increased without increasing the cross section of the in flow passage, relative to the ink flow direction, as it is increased when a conventional filtering portion is employed. Consequently, the pressure loss which occurs when the ink passes through the filter during the recording operation can be reduced, affording an increased amount of the ink supplied per unit of time for high speed printing, and also, ink supply capacity does not deteriorate even when the mesh size of the filter is reduced to increase the print resolution. In addition, the loss of the force which works on the bubbles during the performance restoring operation can be reduced.

While the invention has been described with reference to the structures disclosed herein, it is not confined to the details set forth and this application is intended to cover such modifications or changes as may come within the purposes of the improvements or the scope of the following claims.

What is claimed is:

1. An ink jet apparatus comprising:

an ink container for containing ink;

an ink ejector for ejecting the ink; and a filtering device between said ink container and said ink ejector for providing an ink flow passage for fluid communication between said ink container and said ink ejector, said filtering device comprising:

a filter chamber having a generally trapezoidal section taken along a plane inclined with respect to a horizontal plane, wherein the trapezoidal section has a short side at a vertically upper position and a long side at a vertically lower position, said filter chamber having a top wall at the short side, a liquid inlet to said filter chamber, provided adjacent to the long side, a liquid outlet from said filter chamber, provided adjacent to the short side, and a filter in said filter chamber extending substantially along the inclined plane, said ink outlet being provided with a top end and which extends without step portion from said top wall.

2. An ink jet apparatus according to claim 1, wherein said ink container is disposed above said ink ejector.

3. An ink jet apparatus according to claim 1, wherein said ink flow passage comprises a first ink flow passage connecting said filter and said ink container, and a second ink flow passage connecting said filter chamber and said ink ejector; and said first ink flow passage and said second ink flow passage extend from said filter chamber at an acute angle.

4. A filtering device for a liquid comprising:

a filter chamber having a generally trapezoidal section taken along a plane inclined with respect to a horizontal plane, wherein the trapezoidal section has a short side at a vertically upper position and a long side at a vertically lower position, said filter chamber having a top wall at the short side;

a liquid inlet to said filter chamber, provided adjacent to the long side;

a liquid outlet from said filter chamber, provided adjacent to the short side; and a filter is said filter chamber extending substantially along the inclined plane, said ink outlet being provided with a top end which extends without step portion from said top wall.

5. A filtering device according to claim 4, wherein said filter chamber comprises a sheet member disposed between said filter and said liquid inlet, adjacent to said filter, and said sheet member faces said liquid inlet and covers a part of said filter when an amount of fluid flow per unit of time is more than during a recording operation.

6. A filtering device according to claim 4, wherein said filter chamber is also inclined relative to a direction of gravity.

7. A filtering device according to claim 4, wherein a valve is disposed between the filter of said filter chamber and said first flow passage, and a total area of said valve is smaller than a total area of said filter.

8. A filtering device according to claim 7, wherein a recess is provided in said valve, on a side of said valve facing said filter.

9. An ink jet apparatus comprising:

an ink container for containing ink;

an ink ejector for ejecting the ink; and a filtering device between said ink container and said ink ejector for providing an ink flow passage for fluid communication between said ink container and said ink ejector, said filtering device comprising:

a filter chamber, taken along a plane inclined with respect to a horizontal plane, having a top wall at a vertically upper position and a bottom wall at a vertically lower position, a liquid inlet to said filter chamber, a liquid outlet from said filter chamber, said ink outlet being provided with a top end which extends without step portion from said top wall, a filter in said filter chamber extending substantially along the inclined plane, and a suction recovery means for removing, through said liquid outlet, a bubble attached on said filter at a liquid inlet side adjacent the top wall.

* * * * *

UNITED STATES PATENT AND TRADEMARK OFFICE

CERTIFICATE OF CORRECTION

PATENT NO. : 6,120,140
DATED : September 19, 2000
INVENTOR(S) : Toshiaki Hirosawa et al.

It is certified that error appears in the above-identified patent and that said Letters Patent is hereby corrected as shown below:

Title page, Item [54], and Column 1, Line 1,
"AND INK" should read -- AND INK JET --.

Column 1,
Lines 11 and 29, "an" should read -- a --.

Column 2,
Line 41, "instable," should read -- unstable, --.

Column 4,
Line 26, "bubble sin" should read -- bubbles in --.
Line 56, "instable" should read -- unstable --.

Column 5,
Line 21, "an" (first occurrence) should read -- are --.
Line 28, "is a" should read -- are --.

Column 6,
Line 7, "dose" should read -- does --.

Column 7,
Line 56, "at" should read -- or --.

Column 8,
Line 42, "can not" should read -- cannot --.
Line 54, "correspondent" should read -- corresponding --.

Column 9,
Line 37, "files" should read -- flies --.

Column 11,
Line 41, "an" should be deleted.

Column 12,
Line 50, "adhere" should read -- to adhere --.
Line 57, "pass reliably" should read -- reliably pass --.
Line 61, "into" should be deleted.
Line 63, "becomes" should read -- become --.

UNITED STATES PATENT AND TRADEMARK OFFICE

CERTIFICATE OF CORRECTION

PATENT NO. : 6,120,140
DATED : September 19, 2000
INVENTOR(S) : Toshiaki Hirosawa et al.

It is certified that error appears in the above-identified patent and that said Letters Patent is hereby corrected as shown below:

Column 14,
Line 26, "is" should read -- in --.

Signed and Sealed this

Twenty-sixth Day of February, 2002

*Attest:*

*Attesting Officer*

JAMES E. ROGAN
*Director of the United States Patent and Trademark Office*